United States Patent [19]

Nasrah

[11] Patent Number: 4,765,556

[45] Date of Patent: Aug. 23, 1988

[54] ROLLING MILL LAYING HEAD

[75] Inventor: Camille S. Nasrah, Worcester, Mass.

[73] Assignee: Morgan Construction Company, Worcester, Mass.

[21] Appl. No.: 47,212

[22] Filed: May 8, 1987

[51] Int. Cl.[4] ..... B21C 47/00; B65H 51/00

[52] U.S. Cl. ..... 242/82; 72/66; 72/135; 242/47

[58] Field of Search ..... 72/66, 135, 371; 242/47, 47.01, 82, 83; 266/106

[56] References Cited

U.S. PATENT DOCUMENTS 4,153,212 5/1979 Bauch et al. ..... 242/47

FOREIGN PATENT DOCUMENTS 0186511 7/1986 European Pat. Off. ..... 242/47

943474 12/1963 United Kingdom ..... 242/82

*Primary Examiner*—E. Michael Combs

*Attorney, Agent, or Firm*—Samuels, Gauthier, Stevens & Kehoe

[57] ABSTRACT

A rolling mill laying head has a first tubular shaft mounted on first bearings for rotation relative to a stationary housing structure. A second hollow shaft carrying a three dimensionally curved laying pipe is mounted on second bearings for rotation relative to the first hollow shaft. Both hollow shafts are rotatably driven in the same direction at different speeds.

7 Claims, 3 Drawing Sheets

ROLLING MILL LAYING HEAD

BACKGROUND OF THE INVENTION

1. Field of the Invention

This invention relates to laying heads of the type employed in rolling mills to coil products such as hot rolled rods.

2. Description of the Prior Art

In the conventional laying head, as schematically depicted in FIG. 1 at 10, a hollow shaft 12 is journalled on bearings 14*a*,14*b* for rotation about an axis A. The shaft carries a three dimensionally curved laying pipe 16 having its entry end 16*a* arranged essentially concentric with the axis A, and its delivery end 16*b* located radially therefrom. Shaft 12 also carries a gear 18 which meshes with a gear 20 on a drive shaft 22, the latter being connected to a drive motor M. A hot rolled product, e.g., steel rod, is directed at mill delivery speeds along axis A into the shaft 12. The product then continues through the laying pipe 16 and exits therefrom in the form of a continuous series of rings 24. Typically, the rings will be received in an overlapping offset pattern on a conveyor 26 where they will be cooled at a controlled rate before finally being gathered into coils.

This type of laying head has operated satisfactorily in the past. However, future difficulties are envisioned as a result of ever increasing mill delivery speeds, particularly with respect to rod mills. For example, current modern day high speed rod mills are operating at mill delivery speeds of around 100 m/sec., thus requiring the laying head shafts to be driven at speeds of around 2,000 RPM. Such speeds are at the high end of the permissible operating range of the shaft bearings. Higher rod mill delivery speeds on the order of 150 m/sec. are now being planned but are in danger of not being implemented due to the inability of the conventional laying heads to accommodate further speed increases.

The objective of the present invention is to provide an improved laying head which has the capability of operating at much higher speeds, without overtaxing the capacity of the shaft bearings.

SUMMARY OF THE INVENTION

The laying head of the present invention has a first hollow shaft rotatably mounted on a first set of bearings carried by a stationary housing structure. The laying pipe is carried on a second hollow shaft which is rotatably mounted on a second set of bearings carried on the first hollow shaft. The rotational axes of both hollow shafts are coincident. The hollow shafts are each rotatably driven in the same direction but at different speeds, with the rotational speed of the second shaft and the laying pipe carried thereon in relation to the housing structure being equal to the sum of the relative rotational speeds between the second hollow shaft and the first hollow shaft, and between the first hollow shaft and the housing structure. Thus, the first and second bearing sets each experience only a percentage of the rotational speed of the laying pipe.

DETAILED DESCRIPTION OF ILLUSTRATED EMBODIMENTS

Figure 1:
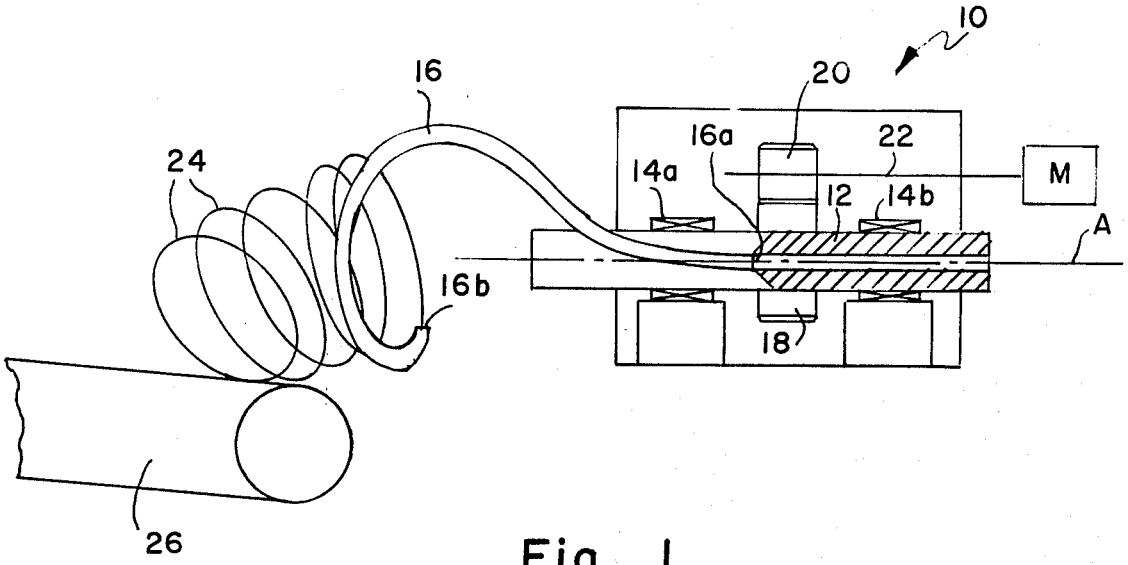
Fig. 1 (Prior Art)
FIG. 1 is a schematic illustration of a typical prior art laying head.
Figure 2:
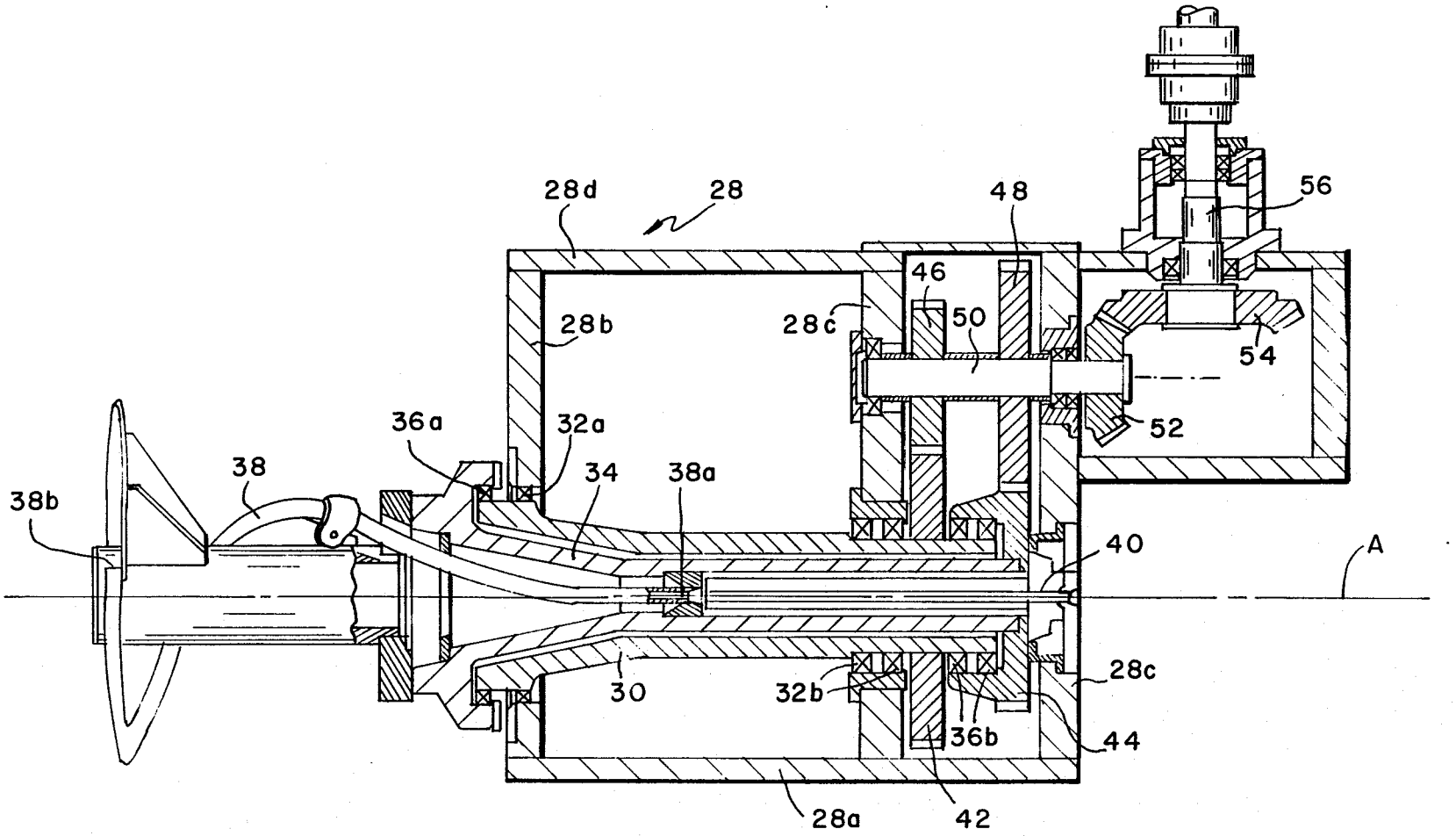
FIG. 2 is a sectional view taken through one embodiment of a laying head in accordance with the present invention.

With reference initially to FIG. 2, a rolling mill laying head is shown comprising a stationary housing structure 28 having a base plate 28*a*, side walls 28*b*,28*c*, a top wall 28*d* and an internal partition 28*c*. A first hollow shaft 30 is supported for rotation about an axis A on first bearing means including bearing sets 32*a* and 32*a*. Bearing set 32*a* is carried by side wall 28*b*, and the bearing sets 32*b* are carried by the housing partition 28*c*.

A second hollow shaft 34 extends axially through the first hollow shaft 30. Second bearing means including bearing sets 36*a* and 36*b* support the second hollow shaft 34 on the first hollow shaft 30 for rotation about the same axis A. A three dimensionally curved laying pipe 38 is carried by the second hollow shaft 34 for rotation therewith. The laying pipe 38 has an entry end 38*a* aligned essentially concentric with axis A, and a delivery end 38*b* located radially from axis A. A tubular product guide 40 is fixed relative to housing side plate 28*c* and extends along axis A into the second hollow shaft 34 to a location proximate to the entry end 38*a* of the laying pipe.

A drive means is employed to rotatably drive the first and second hollow shafts 30,34 in the same direction but at different speeds. The drive means includes first and second driven gears 42,44 keyed or otherwise fixed respectively to the first and second hollow shafts 30,34. First and second drive gears 46,48 are in meshed relationship respectively with the first and second driven gears. The drive gears 46,48 are carried on a common shaft 50 journalled for rotation about an axis parallel to axis A. Shaft 50 may be driven in any convenient manner, for example via bevelled gears 52, 54 and the output shaft 56 of a drive motor (not shown).

With this arrangement, the first hollow shaft 30 is driven at a first speed relative to the housing structure 28, and the second hollow shaft 34 is driven at a second speed relative to the first hollow shaft 30, with the rotational speed of the laying pipe 38 relative to the housing structure 28 being the sum of both of the aforesaid relative speeds. Thus, if the laying pipe 38 must rotate at 3,000 RPM in order to coil hot rolled steel rod exiting from a rolling mill at a delivery speed of 150 m/sec., the first bearing means 32*a*,32*b* need only accommodate a fraction of that speed, typically 1,500 RPM, with the remaining 1,500 RPM being accommodated by the second bearing means 36*a*,36*b*. The net effect is to dramatically increase the capacity of the laying head without exceeding the safe operating range of the bearings.

In the embodiment of FIG. 2, the bearing sets 32*a*,36*a* are axially spaced and of equal diameter, as are the bearing sets 32*b*,36*b*. This is advantageous in that it reduces spare parts requirements.

Figure 3:
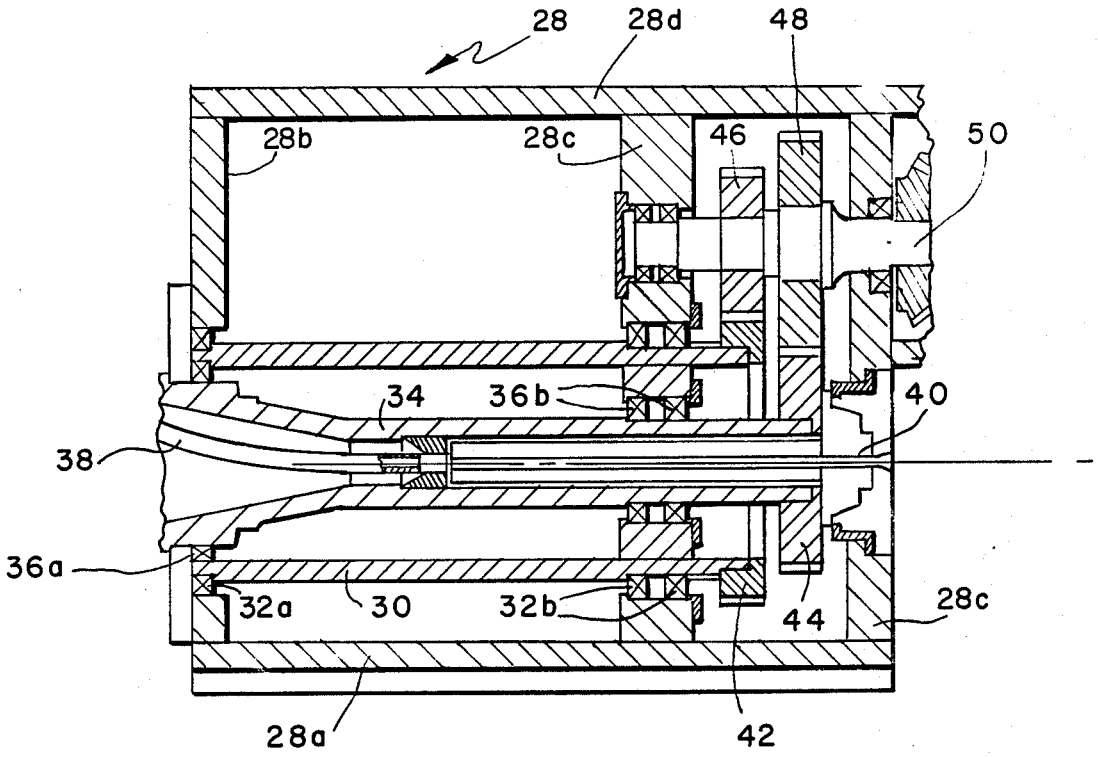
FIG. 3 is a partial sectional view taken through another embodiment of a laying head in accordance with the present invention.

In the alternate embodiment shown in FIG. 3, the bearing sets 32*a*,36*a* are of unequal diameter and are arranged in a coplanar relationship. The same relationship exists between the bearing sets 32*b*,36*b*.

I claim:

1. For use in a rolling mill, a laying head for forming an axially moving elongated product into a series of rings, said laying head comprising:

a stationary housing:

a first hollow shaft;

first bearing means for supporting said first hollow shaft on said housing for rotation about an axis;

a second hollow shaft having at least a portion thereof extending axially through said first hollow shaft;

second bearing means for supporting said second hollow shaft on said first hollow shaft for rotation about said axis;

a laying pipe carried by said second hollow shaft for rotation therewith about said axis, said laying pipe having a three dimensionally curved configuration with an entry end received within said second hollow shaft and aligned essentially concentric with said axis and with a delivery end arranged externally of said second hollow shaft and located radially from said axis;

guide means for directing the axially moving product along said axis and into said entry end for passage through said laying pipe to exit therefrom; and drive means for rotatably driving said first hollow shaft in one direction at a first rotational speed relative to said housing, and for driving said second hollow shaft in the same direction at a second rotational speed relative to said first hollow shaft, the sum of said first and second rotational speeds being equal to the rotational speed of said laying pipe relative to said housing and being sufficient to form the product emerging from the delivery end of said laying pipe into the said series of rings.

2. The laying head of claim 1 wherein said drive means is comprised of first and second driven gears carried respectively on said first and second hollow shafts, and first and second drive gears meshing respectively with said first and second driven gears, said first and second drive gears being carried on a common drive shaft journalled for rotation about an axis parallel to said first mentioned axis.

3. The laying head of claim 1 wherein at least some of said first bearing means are equal in diameter to at least some of said second bearing means.

4. The laying head of claim 3 wherein the said at least some of said first bearing means are spaced axially from the said at least some of said second bearing means.

5. The laying head of claim 1 wherein at least some of said first bearing means are arranged in a coplanar relationship with at least some of said second bearing means.

6. The laying head of claim 5 wherein the said some of said first and second bearing means are of unequal diameter.

7. A rolling mill laying head for forming an axially moving product into a series of coils, said laying head comprising:

a stationary housing:

a hollow support element carried by said housing for rotation relative thereto about an axis;

a laying pipe carried by said support element for rotation relative thereto about the same axis, said laying pipe having an entry end received within said support element in alignment with said axis, and having a delivery end arranged externally of said support element and spaced radially from said axis;

guide means for directing the axially moving product along said axis and into said entry end for passage through said laying pipe to exit therefrom via said delivery end; and drive means for rotatably driving said support element in one direction relative to said housing and for driving said laying pipe in the same direction relative to said support element, with the relative rotational speed of said laying pipe to said housing being equal to the sum of the relative rotational speeds of said laying pipe to said support element and said support element to said housing.

* * * * *